United States Patent [19]

Baker

[11] Patent Number: 4,509,950

[45] Date of Patent: Apr. 9, 1985

[54] EMULSIFYING AGENTS

[75] Inventor: Alan S. Baker, Slough, England

[73] Assignee: Imperial Chemical Industries PLC, London, England

[21] Appl. No.: 478,550

[22] Filed: Mar. 24, 1983

[51] Int. Cl.[3] ..... C10L 1/32

[52] U.S. Cl. ..... 44/51; 44/53; 44/56; 44/57; 252/356

[58] Field of Search ..... 44/51, 53, 56, 57; 252/356

[56] References Cited

U.S. PATENT DOCUMENTS

| | | | |
|---|---|---|---|
| 3,515,669 | 6/1970 | Le Suer | 44/57 |
| 4,256,605 | 3/1981 | Baker | 252/356 |
| 4,347,061 | 8/1982 | Madsen et al. | 44/56 |

*Primary Examiner*—William R. Dixon, Jr.
*Assistant Examiner*—Margaret B. Medley
*Attorney, Agent, or Firm*—Cushman, Darby & Cushman

[57] ABSTRACT

Surfactant compositions suitable for the emulsification of methanol or ethanol in hydrocarbon liquids, especially diesel oil, consist of a blend of (i) from 10% to 90% by weight of block or graft copolymer in which one polymeric component is the residue of an oil-soluble complex monocarboxylic acid and another polymeric component is the residue of a water-soluble polyalkylene glycol or polyalkylenoxy polyol and (ii) from 90% to 10% by weight of a polyester obtained by condensation of a poly(isobutenyl) succinic acid or anhydride with a water-soluble poly(alkylene glycol).

16 Claims, No Drawings

EMULSIFYING AGENTS

This invention relates to novel surfactant compositions which are useful in the production of emulsions of polar liquids in hydrocarbon liquids, in particular of emulsions of methanol and ethanol in hydrocarbon fuels such as diesel oil.

It has been widely proposed, as a way of extending the available reserves of fossil hydrocarbon fuels, to blend petrol or gasoline with minor proportions of ethanol or, to a lesser extent, methanol, these alcohols being in principle obtainable from renewable natural resources. It would likewise be desirable to blend methanol or ethanol with heavier hydrocarbon fuel fractions, such as diesel oil, gas oil and fuel oil, but, in contrast to the situation with petrol or gasoline where the dry alcohol blends are in most cases homogeneous and are therefore straightforward to prepare, problems are encountered in producing the blends with the heavier fractions. On the one hand, the limited miscibility of methanol or ethanol with these fractions means that surface-active additives are required in order to stabilise the blends as emulsions; on the other hand, the fact that both of these alcohols are soluble to some extent in the hydrocarbon liquids in question and vice versa, means that conventional surfactants are not very effective for this purpose.

According to published British application No. 2 051 124A, an emulsion of 20% by weight of methanol, 79% by weight of diesel oil and 1% of emulsifier can be prepared when the emulsifier is a block or graft copolymer of the type having the general formula $(A—COO)_mB$, wherein m is an integer of at least 2, each polymer component A has a molecular weight of at least 500 and is the residue of an oil-soluble complex monocarboxylic acid, and where each polymer component B has a molecular weight of at least 500, and, if m is equal to 2, is the divalent residue of a water-soluble polyalkylene glycol and, if m is higher than 2, is a residue having the valency m of a water-soluble polyether polyol. The emulsion obtained has, however, only a limited stability.

According to published British Application No. 2 002 400A, blends of the above-mentioned block or graft copolymers with conventional surfactants, such as the condensate of nonylphenol with 4 molar proportions of ethylene oxide, are useful for the emulsification of water in hydrocarbon fuel oils and Example 7 of the said application illustrates the case where methanol is additionally present in the disperse phase of the emulsion in order to confer greater stability of the emulsion towards low temperatures. However, in this case the methanol/water mixture contained 75% by weight of water.

We have now found that emulsions of much improved stability of methanol or ethanol, particularly in the heavier hydrocarbon fuel fractions, can be made more readily with the aid of a blend of a block copolymer as above described with a polyester obtained by the condensation of a poly(isobutenyl)succinic anhydride with a poly(alkylene glycol).

The present invention accordingly provides a surfactant composition suitable for the emulsification of methanol or ethanol in a hydrocarbon liquid, the composition being a blend of:

(i) from 10% to 90% by weight of a block or graft copolymer having the general formula $(A—COO)_m—B$, wherein m is an integer at least 2, wherein each polymeric component A has a molecular weight of at least 500 and is the residue of an oil-soluble complex monocarboxylic acid having the general structural formula

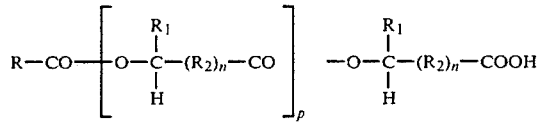

(I)

in which

R is hydrogen or a monovalent hydrocarbon or substituted hydrocarbon group;

$R_1$ is hydrogen or a monovalent $C_1$ to $C_{24}$ hydrocarbon group;

$R_2$ is a divalent $C_1$ to $C_{24}$ hydrocarbon group;

n is zero or 1;

p is an integer from zero up to 200;

and wherein each polymeric component B has a molecular weight of at least 500 and, in the case where m is 2, is the divalent residue of a water-soluble polyalkylene glycol having the general formula

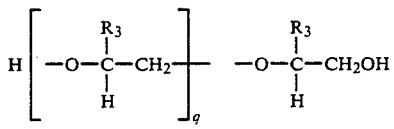

(II)

in which $R_3$ is hydrogen or a $C_1$ to $C_3$ alkyl group;

q is an integer from 10 up to 500;

or in the case where m is greater than 2, is the residue of valency m of a water-soluble polyether polyol having the general formula

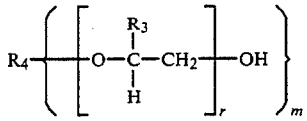

(III)

in which $R_3$ and m have their previous significance;

r is zero or an integer from 1 to 500, provided that the total number of

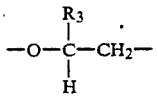

units in the molecule is at least 10;

$R_4$ is the residue of an organic compound containing in the molecule m hydrogen atoms reactive with an alkylene oxide;

with (ii) from 90% to 10% by weight of a polyester which is the product of condensation of (a) a poly(isobutenyl)succinic acid of molecular weight in the range 500–5000 or anhydride thereof with (b) a poly(alkylene glycol) of molecular weight in the range 400–4000 which is soluble in water to the extent of at least 5% by weight at 25° C.

Block or graft copolymers as hereinabove defined are more fully described in the afore-mentioned British Application No. 2 002 400A and reference may be made thereto for details of their composition and the manner in which they may be prepared.

Preferred block or graft copolymers are those in which m in the above formula (I) has a value of 2 and the water-soluble polyalkylene glycol from which the polymeric component B is derived is a polyethylene glycol of molecular weight in the range 1000–4000. It is further preferred that the copolymer should contain from 20% to 50% by weight, especially from 30% to 45% by weight, of the polyethylene glycol-derived polymeric component B.

The polyesters constituting the other component of the compositions of the invention are, as indicated, obtained by condensing in known manner a poly(isobutenyl)succinic acid or anhydride with a poly-(alkylene glycol). The poly(isobutenyl)succinic anhydrides are known commercial materials obtained by an addition reaction between a poly(isobutene) having a terminal unsaturated group and maleic anhydride. Preferably the anhydride used in making the polyester has a molecular weight in the range 500–1500. The poly(alkylene glycol) used is preferably a poly(ethylene glycol) having a molecular weight in the range 600–1500, but a mixed poly(ethylene-propylene glycol) or a mixed poly-(ethylene-butylene glycol) may be used provided that it satisfies the molecular weight and water-solubility requirements stated above.

In addition to the poly(isobutenyl)succinic anhydride and the poly(alkylene glycol), the starting materials from which the polyester is derived may include one or more other polyols of the kind well known for use in polyester manufacture, such as ethylene glycol, propylene glycol, butylene glycol, neopentyl glycol, glycerol, trimethylolpropane, pentaerythritol or sorbitol, and they may also include a drying oil fatty acid such as is commonly used in alkyd resin manufacture, for example tall oil fatty acid or linseed oil fatty acid. It will be understood, therefore, that in the content of the present invention the term "polyester" includes within its scope alkyd resins of the kind specified.

Preferably the polyester contains from 20% to 60% by weight of the poly(alkylene glycol) residues; more preferably, it contains from 25% to 55% of those residues.

The relative proportions of the constituents used in making the polyesters are chosen in accordance with the principles which are well known in the polyester and alkyd resin art, consistent with satisfying the above-stated requirements as to the content in the polyesters of the polyalkylene glycol residues. In general, the proportions are chosen so as to approach a stoichiometric balance between the carboxyl groups derived from the anhydride and the fatty acid, when present, and the hydroxyl groups supplied by the glycol and optional polyol constituent respectively. Preferably this balance, and/or the degree to which the constituents are condensed together, are chosen so that the polyester has an acid value of less than 50 mg KOH/g, preferably less than 25 mg KOH/g.

The relative proportions, in the compositions of the invention, of the block or graft copolymer (i) and the polyester (ii) may vary, within the broad ranges defined above, according to the particular nature of the two phases which are to be emulsified, but the following illustrations of individual constituents (i) and (ii) and of the compositions of blends thereof, are given for general guidance in Tables I, II and III below.

TABLE I

| | 'A' block | | 'B' block | |
|---|---|---|---|---|
| Block copolymer | Composition | Wt. % | Composition | Wt. % |
| Q | Poly(12-hydroxy-stearic acid). | 70 | Polyethyl-ene glycol | 30 |
| R | Poly(12-hydroxy-stearic acid). | 65 | Polyethyl-ene glycol | 35 |
| S | Poly(12-hydroxy-stearic acid). | 60 | Polyethyl-ene glycol | 40 |
| U | Poly(12-hydroxy-stearic acid). | 50 | Polyethyl-ene glycol | 50 |

TABLE II

| | PIBSA | | PEG | | Other | | Fatty | |
|---|---|---|---|---|---|---|---|---|
| Polyester | Mol. wt. | Mols. | Mol. wt. | Mols. | polyol(s) | Mols. | acid | Mols |
| I | 1000 | 1.58 | 800 | 1.07 | NPG | 1.26 | TOFA | 1.45 |
| II | 1000 | 2.99 | 600 | 2.84 | NPG | 0.61 | TOFA | 1.13 |
| III | 1000 | 2.99 | 600 | 3.33 | NPG | 0.12 | TOFA | 1.13 |
| IV | 1000 | 0.56 | 600 | 1.30 | G | 0.15 | TOFA | 1.81 |
| V | 1000 | 0.56 | 600 | 1.50 | G | 0.02 | TOFA | 1.81 |
| VI | 1000 | 1.40 | 800 | 1.65 | PE | 0.02 | — | — |
| | | | 600 | 0.15 | | | | |
| VII | 1000 | 1.53 | 600 | 1.44 | G | 0.56 | TOFA | 1.40 |
| VIII | 1000 | 1.30 | 600 | 1.50 | — | — | TOFA | 0.40 |

Key to abbreviations
PIBSA Poly(isobutenyl)succinic anhydride
PEG Poly(ethylene glycol)
NPG Neopentylglycol
G Glycerol
PE Pentaerythritol
TOFA Tall oil fatty acid Details of the preparation of the polyesters are given below.

TABLE III

| Blend No. | Block Copolymer | % by wt. | Polyester | % by wt. |
|---|---|---|---|---|
| 1 | Q | 50 | IV | 50 |
| 2 | Q | 50 | VI | 50 |
| 3 | Q | 50 | VIII | 50 |
| 4 | R | 50 | III | 50 |
| 5 | R | 50 | IV | 50 |
| 6 | R | 50 | V | 50 |

TABLE III-continued

| Blend No. | Block Copolymer | % by wt. | Polyester | % by wt. |
|---|---|---|---|---|
| 7 | R | 50 | VIII | 50 |
| 8 | S | 50 | I | 50 |
| 9 | S | 50 | II | 50 |
| 10 | S | 50 | VII | 50 |
| 11 | U | 20 | VII | 80 |

According to a further aspect of the present invention, there is provided an emulsion of methanol or ethanol in a liquid hydrocarbon fuel, the emulsion containing from 1% to 75% by weight of methanol or ethanol as the disperse phase and from 25% to 99% by weight of the hydrocarbon fuel as the continuous phase, and in addition, as emulsifying agent, from 1% to 100% by weight, based on the disperse phase, of a surfactant composition as hereinabove defined. From a practical point of view, particular interest centres around emulsions which contain from 5% to 60% of methanol or ethanol and from 40% to 95% of hydrocarbon fuel, since the fuel value of the emulsion falls off steadily with increasing alcohol content and the viscosity rises as the disperse phase volume increases.

Hydrocarbon fuels in which methanol or ethanol may be emulsified according to the invention include, for example, commercial grade diesel oil, '35 seconds' gas oil, No. 3 fuel oil, commercial grade '2-star' petrol and commercial grade mineral oil (having a viscosity of 60 centistokes at 40° C.).

Although the disperse phase of the emulsions may consist of essentially pure methanol or ethanol, emulsions of practical interest may be obtained according to the invention in which the methanol or ethanol contains up to 20% of its weight in water. In commercial application, water contents in the range 5–10% by weight may commonly be encountered. In general, where the water content of the methanol or ethanol is low, it is preferred to employ, as the block or graft copolymer constituent of the surfactant composition, a copolymer having a content of the component B lying towards the upper end of the preferred range previously referred to, viz. a value in the region of 40–45%; conversely, where the methanol or ethanol contains proportions of water approaching the maximum of 20%, it is preferred to use a block or graft copolymer having a lower content of component B, in the region of 30%.

The proportion of the surfactant composition employed to the total amount of the emulsion will vary, within the broad range stated above, not only according to the nature and relative proportions of the two constituents of the surfactant blend but also according to whether it is methanol or ethanol that is to be emulsified and according to the water content of the alcohol. In general, the higher the water content, the easier it becomes to emulsify the alcohol because of the greater degree of its immiscibility with the hydrocarbon. With methanol, or with ethanol containing 5% or more of water, stable emulsions are readily formed in diesel oil using a proportion of the surfactant composition in the range 1% to 20%, preferably 3% to 10% and more preferably in the region of 5%, by weight of the alcohol phase. However, with certain combinations, for example that of ethanol containing less than 5% of water with diesel oil, where the disperse phase has a significant but finite degree of miscibility with the continuous phase, it may be necessary to use an amount of the surfactant composition which approaches the actual amount of the alcohol in the mixture, if stable products are to be obtained. These products differ from the other emulsions according to the invention, which are characteristically turbid and contain disperse phase droplets of a size in the region of 0.1 microns or more, in being only slightly hazy or even completely clear, like a solution. The physical state of the alcohol constituent in these cases is not completely elucidated, but it is evident that the average size of the disperse phase droplets must be very small, perhaps of the order of a few tens or hundreds of Ångstrom units only; for convenience these products may be referred to as "microemulsions".

The optimum surfactant composition for any particular system to be emulsified can, however, readily be ascertained by simple experiment.

The emulsions according to the invention are conveniently produced by first dissolving or dispersing the selected emulsifier blend in the hydrocarbon liquid, with the aid of gentle heating where necessary. The alcohol phase is then added, initially under low speed mixing conditions and if necessary subsequently at high speed for a period of 1–2 minutes, ensuring that the temperature does not exceed a value at which significant evaporation of the alcohol phase occurs, e.g. about 40° C. The resulting emulsion is considered to be stable if no more than slight separation of either phase is detectable after 5 days' storage at ambient temperature, any separation being redispersible by gentle agitation.

There may, if desired, be present in the emulsions of the invention conventional fuel additives. Thus, for example, there may be incorporated in the alcohol phase of a diesel oil emulsion a lubricant whereby siezing of the fuel injection pump of an engine powered by the emulsion may be prevented.

The invention is illustrated but not limited by the following Examples, in which parts, ratios and percentages are by weight.

PREPARATION OF POLYESTERS

Polyester I

Polyethylene glycol, mol.wt. 800 (28.65 parts), neopentyl glycol (4.39 parts), PIBSA, mol. wt. 1000 (52.89 parts) and tall oil fatty acids (14.08 parts) were condensed together to an acid value of 10.7 mg KOH/g, using xylene (5.6 parts) as entraining solvent. The resulting polyester had a viscosity of 2.7 secs. Bubble Tube (measured at 75% solids in xylene at 25° C.).

Polyester II

Polyethylene glycol, mol.wt. 600 (33.51 parts), neopentyl glycol, (1.25 parts), PIBSA, mol.wt. 1000 (58.8 parts) and tall oil fatty acids (6.44 parts) were condensed together in the presence of xylene (6.0 parts) to an acid value of 9.5 mg KOH/g. The resulting polyester had a viscosity of 7.5 secs. Bubble Tube (80% solids in xylene at 25° C.).

Polyester III

Polyethylene glycol, mol.wt. 600 (37.5 parts), neopentyl glycol (0.23 part), PIBSA, mol.wt. 1000 (56.12 parts) and tall oil fatty acids (6.14 parts) were condensed in the presence of xylene (5.3 parts) to an acid value of 10.1 mg KOH/g. The resulting polyester had a viscosity of 6.8 secs. Bubble Tube (80% solids in xylene at 25° C.).

Polyester IV

Polyethylene glycol, mol.wt. 600 (41.58 parts), glycerol (0.72 part), PIBSA, mol.wt. 1000 (29.70 parts) and tall oil fatty acids (28.00 parts) were condensed together in the presence of xylene (6.0 parts) to an acid value of 9.4 mg KOH/g. The resulting polyester had a viscosity of 6.6 secs. Bubble Tube (95% solids in xylene at 25° C.).

Polyester V

Polyethylene glycol, mol.wt. 600 (45.37 parts), glycerol (0.10 part), PIBSA, mol.wt. 1000 (28.07 parts) and tall oil fatty acids (26.46 parts) were condensed together in the presence of xylene (5.33 parts) to an acid value of 10.0 mg KOH/g. The resulting polyester had a viscosity of 6.7 secs. Bubble Tube (95% solids in xylene at 25° C.).

Polyester VI

Polyethylene glycol, mol.wt. 800 (46.95 parts), polyethylene glycol, mol.wt. 600 (3.21 parts), pentaerythritol (0.09 part) and PIBSA, mol.wt. 1000 (49.77 parts) were condensed together in the presence of xylene (6.2 parts) to an acid value of 7.2 mg KOH/g. The resulting polyester had a viscosity of 11 secs. Bubble Tube (80% solids in xylene at 25° C.).

Polyester VII

Polyethylene glycol, mol.wt. 600 (30.30 parts), glycerol (1.80 parts), PIBSA, mol.wt. 1000 (53.66 parts) and tall oil fatty acids (14.24 parts) were condensed together in the presence of xylene (5.8 parts) to an acid value of 10.4 mg KOH/g. The resulting polyester had a viscosity of 4 secs. Bubble Tube (75% solids in xylene at 25° C.).

Polyester VIII

Polyethylene glycol, mol.wt. 600 (38.9 parts), PIBSA, mol.wt. 1000 (56.1 parts) and tall oil fatty acids (5.0 parts) were condensed together in the presence of xylene (5.8 parts) to an acid value of 13.3 mg KOH/g. The resulting polyester had a viscosity of 8.7 secs. Bubble Tube (80% solids in xylene at 25° C.).

EXAMPLES

General Procedure

The block or graft copolymer constituent and the polyester constituent, as identified in detail below, were blended together and then dissolved or dispersed in the hydrocarbon liquid, with the assistance of mild heat where necessary (not exceeding a temperature of 50° C.). The alcohol phase, as identified below, was then added to the hydrocarbon phase with low speed mixing, followed where necessary by high speed mixing for 1–2 minutes.

EXAMPLE 1

"Microemulsion" of 99% ethanol in diesel oil 20 parts of 99% ethanol were added to 80 parts of diesel oil and 20 parts of the surfactant blend 10 (see Table III above). On hand stirring of the mixture, a stable microemulsion was formed.

EXAMPLE 2

"Microemulsion" of 95% ethanol in diesel oil

The procedure of Example 1 was repeated, but using 95% ethanol in place of 99% ethanol. A similar result was obtained.

EXAMPLE 3

Emulsion of 95% ethanol in diesel oil 20 parts of 95% ethanol were added to a mixture of 79 parts of diesel oil and 1 part of surfactant blend 9. A stable emulsion was formed when the mixture was subjected to the general procedure outlined above.

EXAMPLE 4

Emulsions of 90% ethanol in diesel oil 20 parts of 90% ethanol were added to a mixture of 79 parts of diesel oil and 1 part of surfactant blend 6. The mixture was emulsified according to the general procedure and a stable emulsion was obtained. Similar results were obtained when blend 6 was replaced by the same amount of blend 1, blend 3 and blend 10 respectively.

EXAMPLE 5

Emulsions of 80% ethanol in diesel oil 20 parts of 80% ethanol were added to a mixture of 79 parts of diesel oil and 1 part of surfactant blend 7. The mixture was emulsified according to the general procedure, giving a stable emulsion. Similar results were obtained on replacing blend 7 by the same amount of blend 5 and blend 6 respectively.

EXAMPLE 6

Emulsions of 100% methanol in diesel oil 20 parts of 100% methanol were added to a mixture of 79 parts of diesel oil and 1 part of surfactant blend 4. The mixture was emulsified according to the general procedure and a stable emulsion was obtained. A similar result was obtained when blend 4 was replaced by the same amount of blend 8 and blend 11 respectively.

EXAMPLE 7

Emulsions of 90% methanol in diesel oil 20 parts of 90% methanol were added to a mixture of 79 parts of diesel oil and 1 part of surfactant blend 9. The mixture was emulsified according to the general procedure, giving a stable emulsion. A similar result was obtained when blend 9 was replaced by the same amount of blend 7.

EXAMPLE 8

Emulsions of 80% methanol in diesel oil 20 parts of 80% methanol were added to a mixture of 79 parts of diesel oil and 1 part of surfactant blend 5. The mixture was emulsified according to the general procedure, giving a stable emulsion. When blend 5 was replaced by the same amount of blend 2, a similar result was obtained.

What we claim is:

1. A surfactant composition suitable for the emulsification of methanol or ethanol in a hydrocarbon liquid, the composition being a blend of:

(i) from 10% to 90% by weight of a block or graft copolymer having the general formula $(A—COO)_m—B$, wherein m is an integer at least 2, wherein each polymeric component A has a molecular weight of at least 500 and is the residue of an oil-soluble complex monocarboxylic acid having the general structural formula

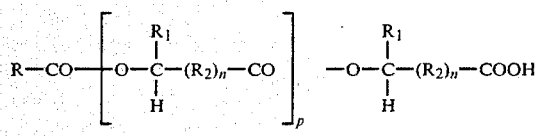

(I)

in which

R is hydrogen or a monovalent hydrocarbon or substituted hydrocarbon group;

$R_1$ is hydrogen or a monovalent $C_1$ to $C_{24}$ hydrocarbon group;

$R_2$ is a divalent $C_1$ to $C_{24}$ hydrocarbon group;

n is zero or 1;

p is an integer from zero up to 200;

and wherein each polymeric component B has a molecular weight of at least 500 and, in the case where m is 2, is the divalent residue of a water-soluble polyalkylene glycol having the general formula

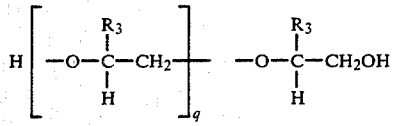

(II)

in which $R_3$ is hydrogen or a $C_1$ to $C_3$ alkyl group;

q is an integer from 10 up to 500;

or in the case where m is greater than 2, is the residue of valency m of a water-soluble polyether polyol having the general formula

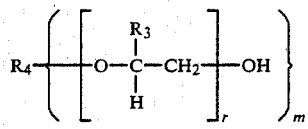

(III)

in which $R_3$ and m have their previous significance;

r is zero or an integer from 1 to 500, provided that the total number of

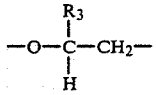

units in the molecule is at least 10;

$R_4$ is the residue of an organic compound containing in the molecule m hydrogen atoms reactive with an alkylene oxide;

with (ii) from 90% to 10% by weight of a polyester which is the product of condensation of (a) a poly(isobutenyl)succinic acid of molecular weight in the range 500–5000, or anhydride thereof, with (b) a poly(alkylene glycol) of molecular weight in the range 400–4000 which is soluble in water to the extent of at least 5% by weight at 25° C.

2. A composition as claimed in claim 1, wherein the block or graft copolymer is one according to formula (I) where m has a value of 2 and the water-soluble polyalkylene glycol from which the polymeric component B is derived is a polyethylene glycol of molecular weight in the range 1000–4000.

3. A composition as claimed in claim 1, wherein the copolymer contains from 20% to 50% by weight of the polyethylene glycol-derived polymeric component B.

4. A composition as claimed in claim 3, wherein the copolymer contains from 30% to 45% by weight of the polyethylene glycol-derived polymeric component B.

5. A composition as claimed in claim 1, wherein the polymeric component A of the block or graft copolymer is the residue of poly(12-hydroxystearic acid).

6. A composition as claimed in claim 1, wherein the poly(isobutenyl)succinic anhydride used in making the polyester constituent (ii) has a molecular weight in the range 500–1500.

7. A composition as claimed in claim 1, wherein the poly(alkylene glycol) used in making the polyester constituent (ii) is a poly(ethylene glycol) having a molecular weight in the range 600–1500.

8. A composition as claimed in claim 1, wherein the polyester constituent (ii) contains from 20% to 60% by weight of the poly(alkylene glycol) residues.

9. A composition as claimed in claim 8, wherein the polyester contains from 25% to 55% by weight of the poly(alkylene glycol) residues.

10. A composition as claimed in claim 1, wherein the polyester has an acid value of less than 50 mg KOH/g.

11. A composition as claimed in claim 10, wherein the acid value is less than 25 mg KOH/g.

12. An emulsion of methanol or ethanol in a liquid hydrocarbon fuel, the emulsion containing from 1% to 75% by weight of methanol or ethanol as the disperse phase, the methanol or ethanol containing at least 1% by weight of water, and from 25% to 99% by weight of the hydrocarbon fuel as the continuous phase, and in addition, an emulsifying agent; from 1% to 100% by weight, based on the disperse phase, of a surfactant as claimed in claim 1.

13. An emulsion as claimed in claim 12, containing from 5% to 60% of methanol or ethanol and from 40% to 95% of hydrocarbon fuel.

14. An emulsion as claimed in claim 12, wherein the hydrocarbon fuel is a commercial grade diesel oil.

15. An emulsion as claimed in claim 12, wherein the methanol or ethanol contains up to 20% of its weight of water.

16. An emulsion as claimed in claim 12 wherein the methanol or ethanol contains 5–10% by weight of water.

* * * * *